US007786378B2

(12) United States Patent
Kondo et al.

(10) Patent No.: US 7,786,378 B2
(45) Date of Patent: Aug. 31, 2010

(54) ELECTRIC WIRE FOR AUTOMOBILE

(75) Inventors: Mamoru Kondo, Yokkaichi (JP); Masanobu Yoshimura, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 12/379,752

(22) Filed: Feb. 27, 2009

(65) Prior Publication Data

US 2009/0166057 A1 Jul. 2, 2009

Related U.S. Application Data

(63) Continuation of application No. 10/792,853, filed on Mar. 5, 2004, now Pat. No. 7,528,319.

(30) Foreign Application Priority Data

Mar. 6, 2003 (JP) ..... 2003-059964
Mar. 3, 2004 (JP) ..... 2004-058661

(51) Int. Cl.
*H01B 7/00* (2006.01)

(52) U.S. Cl. ..... 174/36; 174/126.1

(58) Field of Classification Search ..... 174/36, 174/102 R, 108, 128.1, 128.2
See application file for complete search history.

(56) References Cited

U.S. PATENT DOCUMENTS 2,778,870 A * 1/1957 Nolan ..... 174/128.1
3,231,665 A * 1/1966 Grimes, Jr. et al. ..... 174/108
3,240,570 A * 3/1966 Grimes, Jr. et al. ..... 57/214
3,345,456 A 10/1967 Gilmore
3,647,939 A 3/1972 Schoemer
4,078,299 A 3/1978 Furuto et al.
4,158,283 A * 6/1979 Nation ..... 57/200
4,463,219 A * 7/1984 Sato ..... 174/127
4,640,983 A * 2/1987 Comte ..... 174/119 R
4,676,058 A * 6/1987 Foley et al. ..... 57/218
4,689,444 A * 8/1987 Burgess ..... 174/128.1
5,640,766 A 6/1997 Fujino et al.
5,994,647 A 11/1999 Avellanet
6,576,844 B1 6/2003 Kamata

FOREIGN PATENT DOCUMENTS

EP 0 331 182 B2 4/1994
JP A-01-157005 6/1989
JP A-01-225006 9/1989
JP A-06-013014 1/1994
JP A-09-147631 6/1997
JP A-2003-308738 10/2003
JP A-2004-207079 7/2004
WO WO 02/071563 A1 9/2002

* cited by examiner

*Primary Examiner*—William H Mayo, III
(74) *Attorney, Agent, or Firm*—Oliff & Berridge, PLC

(57) ABSTRACT

A conductor for an automobile is provided. The conductor is configured by compressing a plurality of surrounding wires that surround a central wire. Individual wires of single materials are combined in various combinations. Materials from which individual wires are formed in one embodiment are one of stainless steel, copper or copper alloy. Materials from which individual wires are formed in another embodiment are one of stainless steel, aluminum or aluminum alloy.

14 Claims, 3 Drawing Sheets

ELECTRIC WIRE FOR AUTOMOBILE

This is a Continuation of application Ser. No. 10/792,853 filed Mar. 5, 2004 (now U.S. Pat. No. 7,528,319). This application claims the benefit of Japanese Patent Application Nos. 2003-059964, filed Mar. 6, 2003 and 2004-058661, filed Mar. 3, 2004. The entire disclosure of each of the prior applications is hereby incorporated by reference herein in its entirety.

BACKGROUND OF THE INVENTION

1. Field of the Invention

The present invention relates to an electric wire for an automobile, particularly relates to an electric wire for an automobile constituted by slender wire formation and light-weighted formation and promoting reliability of connection.

2. Description of the Related Art

In an automobile, there is used a wire harness which bundles a number of electric wires for electrically connecting to an electric equipment or the like. An electric wire conductor in the wire harness requires its tensile strength to be equal to or larger than about 60 N/mm$^2$ in view of workability. A sectional area (hereinafter, also referred to as "conductor size") equal to or larger than 0.35 mm$^2$ is required in case of a single electric wire.

There is the electric wire for a wire harness having a conductor in a twisted wire structure constituted by twisting together a plurality of wires. FIG. 1 shows an example of the conductor. In FIG. 1, numeral 1 designates the conductor which is constituted a twisted wire structure arranging 6 surrounding wires 3 to surround a central wire 2 to twist together. In a related art, it is known to use copper or a copper alloy for both of the central wire 2 and the surrounding wire 3 constituting the conductor with the twisted wire structure.

In an automobile in recent years, slender wire formation (for example, the conductor size equal to or smaller than 0.22 mm$^2$) and light-weighted formation of an electric wire used have been requested. However, when a conductor (central wire, surrounding wire) uses copper or a copper alloy, a required tensile strength cannot be achieved by the slender wire formation and light-weighed formation.

Hence, JP-UM-A-6-13014 discloses that the conductor uses a composition of both copper or a copper alloy and stainless steel for wires in order to achieve the slender wire formation and light-weighed formation. The composition has stainless steel as a central wire and a plurality of surrounding wires made of soft copper are arranged to surround the central wire so that twisted wire structure of the composition is formed. Since stainless steel is provided with a small specific weight in comparison with that of copper or a copper alloy and stainless steel is provided with a tensile strength, slender wire formation and light-weighted formation are achieved.

However, in the case of the electric wire having the conductor as described in the publication, when the electric wire is pressed at a connecting portion, stainless steel constituting the central wire in a conductor barrel of a connecting terminal may not be crushed but shifted from a central position. A reliability of connection is insufficient. In this way, there is desired to realize a technology achieving a required tensile strength, achieving slender wire formation and light-weighted formation and ensuring reliability of connection.

SUMMARY OF THE INVENTION

It is an object of the invention to resolve such a problem of the related art and provide an electric wire for an automobile capable of achieving slender wire formation and light-weighted formation and ensuring reliability of connection without lowering a tensile strength.

According to one aspect of the invention, there is provided with an electric wire for an automobile having a compressed wire configured by compressing a conductor having a plurality of surrounding wires to surround a central wire, wherein the surrounding wire and the central wire are made of copper or a copper alloy and a stainless steel.

According to second aspect of the invention, the electric wire of the first aspect is configured that the central wire s made of the stainless steel, and that the surrounding wires are made of copper or the copper alloy.

According to third aspect of the invention, the electric wire of the second aspect is configured that the surrounding wires consist of six wires, and that the surrounding wires form a single layer.

According to fourth aspect of the invention, the electric wire according to the second aspect is configured that the surrounding wires form two layers, the surrounding wires consist of six wires in first layer of the two layers to surround the central wire, and the surrounding wires consists of twelve wires in a second layer of the two layers to surround the first layer.

According to fifth aspect of the invention, the electric wire according to the first aspect is configured that the central wire is made of the stainless steel, the surrounding wires have first surrounding wires made of copper or the copper alloy and second surrounding wires made of the stainless steel, and the first surrounding wires and the second surrounding wires are alternately arranged one another.

According to sixth aspect of the invention, the electric wire according to the fifth aspect is configured that the surrounding wires form a single layer, the surrounding wires consist of six wires.

According to seventh aspect of the invention, the electric wire according to the sixth aspect is configured that twelve surrounding wires made of copper or copper alloy is disposed to surround the single layer.

According to eighth aspect of the invention, the electric wire according to the first aspect is configured that the central wire is made of the stainless steel, the surrounding wires form two layers, the surrounding wires are made of the stainless steel in a first layer of the two layers to surround the central wire, and the surrounding wires are made of copper or the copper alloy in a second layer of the two layers to surround the first layer.

According to ninth aspect of the invention, the electric wire according to first aspect is configured that the central wire is made of copper or the copper alloy, the surrounding wires have first surrounding wires made of the stainless steel and second-surrounding wires made of copper or the copper alloy, and the first surrounding wires and the second surrounding wires are alternately arranged one another.

According to tenth aspect of the invention, the electric wire according to ninth aspect is configured that the surrounding wires form a single layer, and the surrounding wires consist of six wires.

According to eleventh aspect of the invention, the electric wire of the tenth aspect is configured that twelve surrounding wires made of copper or the copper alloy is disposed to surround the single layer.

According to twelfth aspect of the invention, the electric wire of the first aspect configured that a sectional area of the wire made of stainless steel is equal to a sectional area of the wire made of the copper or the copper alloy.

According to thirteenth aspect of the invention, the electric wire of the first aspect is configured that a sectional area of the wire made of the stainless steel is smaller than a sectional area of the wire made of copper or the copper alloy.

According to fourteenth aspect of the invention, the electric wire of the thirteenth aspect is configured that the sectional area of the wire made of the stainless steel is set in 70% through 95% of the sectional area of the wire of copper or the copper alloy.

According to fifteenth aspect of the invention, there is provided with an electric wire for an automobile having a compressed wire configured by compressing a conductor having a plurality of surrounding wires to surround a central wire, wherein the surrounding wires and the central wire are made of aluminum or an aluminum alloy and a stainless steel.

According to sixteenth aspect of the invention, the electric wire of the fifteenth aspect is configured that the central wire is made of the stainless steel, and wherein the surrounding wires are made of aluminum or the aluminum alloy.

According to seventeenth aspect of the invention, the electric wire of the sixteenth aspect is configured that the surrounding wires consist of six wires, and the surrounding wires form a single layer.

According to eighteenth aspect of the invention, the electric wire of the sixteenth aspect is configured that the surrounding wires form two layers, the surrounding wires have six wires in first layer of the two layers to surround the central wire, and the surrounding wires have twelve wires in a second layer of the two layers to surround the first layer.

According to nineteenth aspect of the invention, the electric wire of the fifteenth aspect is configured that the central wire is made of the stainless steel, the surrounding wires have first surrounding wires made of aluminum or the aluminum alloy and second surrounding wires made of the stainless steel, and the first surrounding wires and the second surrounding wires are alternately arranged one another.

According to twentieth aspect of the invention, the electric wire nineteenth aspect is configured that the surrounding wires form a single layer, the surrounding wires have six wires.

According to twenty-first aspect of the invention, the electric wire twentieth aspect is configured that twelve surrounding wires made of aluminum or the aluminum alloy is disposed to surround the single layer.

According to twenty-second aspect of the invention, the electric wire of the fifteenth aspect is configured that the central wire is made of the stainless steel, the surrounding wires form two layers, the surrounding wires are made of the stainless steel in a first layer of the two layers to surround the central wire, and the surrounding wires are made of the aluminum or the aluminum alloy in a second layer of the two layers to surround the first layer.

According to twenty-third aspect of the invention, the electric wire of the fifteenth aspect is configured that the central wire is made of aluminum or the aluminum alloy, the surrounding wires have first surrounding wires made of the stainless steel and second surrounding wires made of aluminum or the aluminum alloy, and the first surrounding wires and the second surrounding wires are alternately arranged one another.

According to twenty fourth aspect of the invention, the electric wire twenty third aspect is configured that the surrounding wires form a single layer, the surrounding wires consist of six wires.

According to twenty-fifth aspect of the invention, the electric wire twenty fourth aspect is configured that twelve surrounding wires made of aluminum or the aluminum alloy is disposed to surround the single layer.

According to twenty-sixth aspect of the invention, the electric wire fifteenth aspect is configured that a sectional area of the wire made of stainless steel is equal to a sectional area of the wire made of aluminum or the aluminum alloy.

According to twenty-seventh aspect of the invention, the electric wire fifteenth aspect is configured that a sectional area of the wire made of the stainless steel is smaller than a sectional area of the wire made of aluminum or the aluminum alloy.

According to twenty-eighth aspect of the invention, the electric wire twenty seventh aspect is configured that the sectional area of the wire made of the stainless steel is set in 70% through 95% of the sectional area of the wire made of aluminum or the aluminum alloy.

DESCRIPTION OF THE PREFERRED EMBODIMENTS

According to one aspect of the invention, there is provided with an electric wire for automobile has a compressed conductor which is configured by compressing a conductor including a plurality of surrounding wires to surround the central wire. The wires are configured by combination of wire made of stainless steel and wire made of copper or a copper alloy.

An explanation will be given of a mode for carrying out the invention by preferred embodiments as follows.

According to another aspect of the invention, there is provided with a first electric wire for an automobile which compresses a conductor configured by closely contacting a plurality of surrounding wires to surround a central wire made of stainless steel (SUS).

Figure 1:
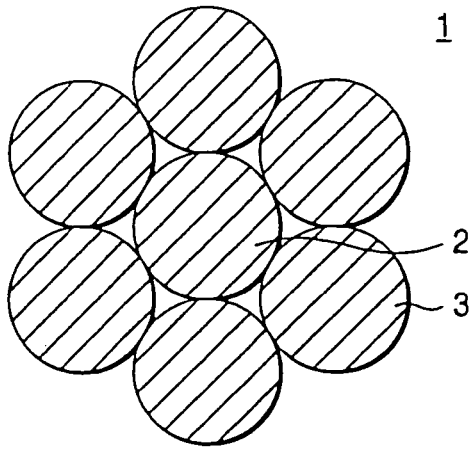
FIG. 1 RELATED ART
FIG. 1 is a sectional view of an electric wire conductor for an automobile of a twisted wire structure in a related art.
Figure 2:
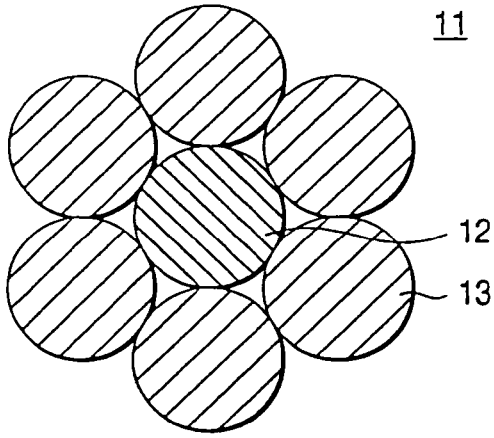
FIG. 2 is a sectional view (before being compressed) of a constitution example of a first electric wire conductor for an automobile according to the invention.
Figure 3:
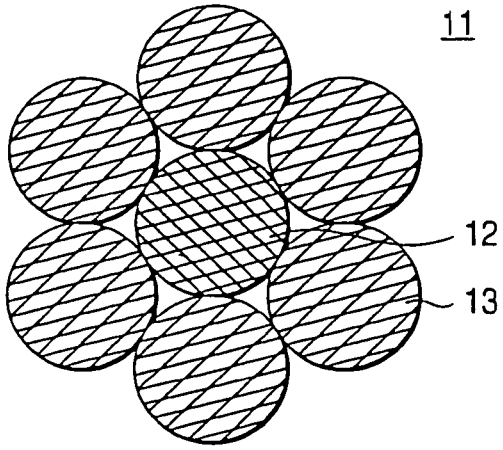
FIG. 3 is a sectional view (after being compressed) of the constitution example of the first electric wire conductor for the automobile according to the invention.

FIG. 2 shows a sectional view of a state before compressing a conductor in an example of the first electric wire. In FIG. 2, numeral 11 designates an aggregate of the conductor before being compressed. Six surrounding wires 13 having copper or the copper alloy are arranged and twisted together at a surrounding of a central wire 12 comprising stainless steel to thereby constitute a twisted wire structure. Further, a sectional area of the central wire 12 is equal to a sectional area of the surrounding wire 13. Such an aggregate is compressed to constitute a sectional area of 85 through 95% of a sectional area before being compressed by using, for example, a compression die or the like to thereby constitute the compressed conductor. An insulating cover is directly covered to surround the compressed conductor or via a shield layer to thereby constitute an electric wire for an automobile.

In the above-described, as stainless steel used for the central wire 12, various kinds thereof can be used, SUS304, SUS316 and the like having a large tensile strength are particularly preferable. The sectional area of the central wire 12 is pertinently set in accordance with use. The sectional area is normally about $2.0\times10^{-3}$ through 0.07 $mm^2$ before being compressed.

As copper or a copper alloy for the surrounding wires 13, various kinds of types used for a normal electric wire can be used. Pure copper, Cu—Ag alloy, Cu—Ni—Si alloy and the like are preferably used in view of conductivity, tensile strength, elongation or the like. Although the sectional area of the surrounding wire 13 is pertinently set in accordance with use, normally, the sectional area is about $2\times10^{-3}$ through 0.1 $mm^2$ before being compressed.

As the insulating cover, various resin materials of polyvinyl chloride (PVC), polyethylene (including foamed species) a halogen free material, tetrafluoroethylene and the like can be used. A thickness of the insulating cover is pertinently set in accordance with an outer diameter of the compressed conductor. When the shield layer is provided, various materials having shield effect which are known in related arts can be used.

By constituting the first electric wire for an automobile as described above, the central wire 12 including stainless steel is fixed at the center of the compressed conductor. The tensile strength is sufficiently achieved as a whole and therefore, slender wire formation and light-weighted formation can be carried out. Further, when a distal end of the electric wire is pressed to connect to a connecting terminal at a connecting portion, an area of copper or a copper alloy brought into contact with the terminal is increased and therefore, reliability of connection is promoted.

The first electric wire for an automobile is not limited only to the illustrated constitution example but can variously be modified or changed.

Figure 6:
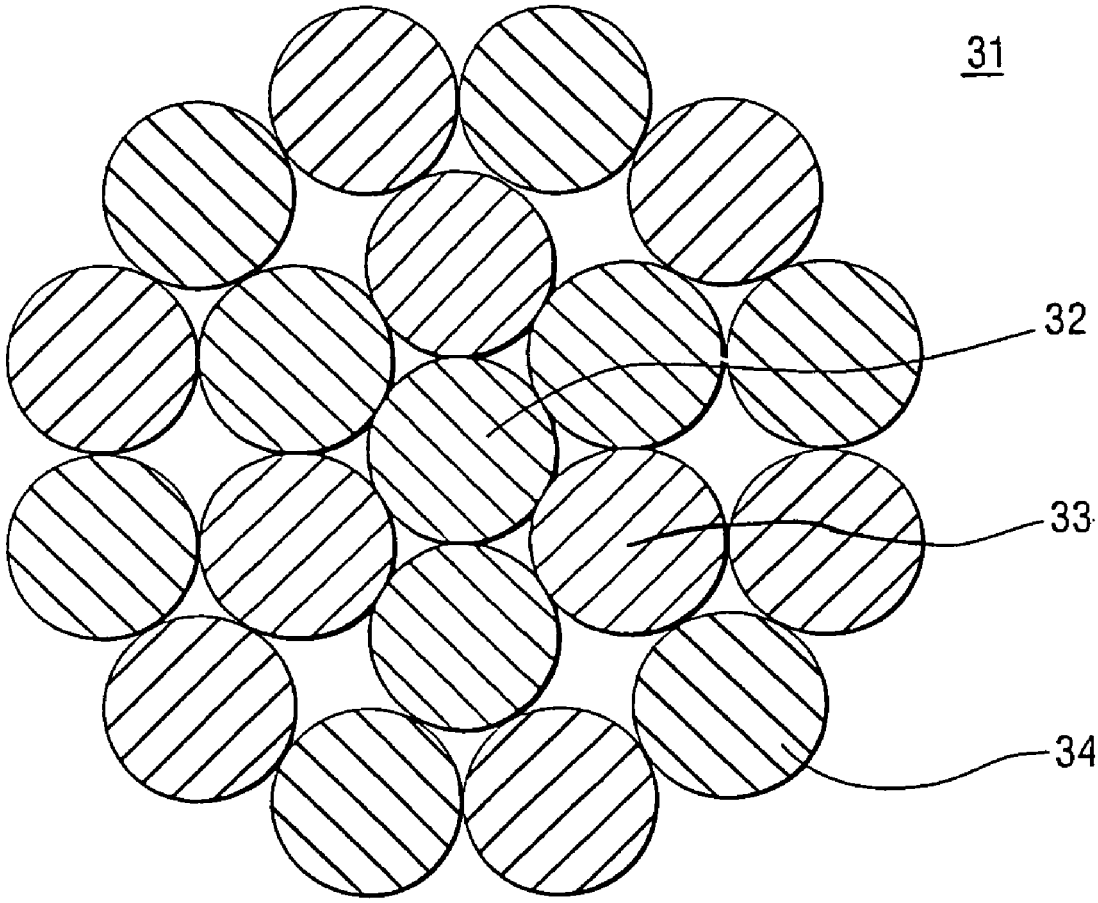
FIG. 6 is a sectional view (before being compressed) of a conductor according to another constitution example of an electric wire for an automobile.

For example, although the first electric wire has 6 surrounding wires to surround the central wire (as 7 twisted type), the first electric wire may be 19 twisted type in which the first electric wire of the 7 twisted type has further 12 surrounding wires to surround the 6 surrounding wires. FIG. 6 illustrates a structure of an electric wire 31 having the 19 twisted type. As shown in FIG. 6, the electric wire 31 includes a central wire 32, a first layer including 6 surrounding wires 33 and a second layer including 12 surrounding wires 34. The first electric wire may be constituted without the twisted wire structure.

Although the sectional area of the stainless steel wire (as the central wire) is equal to that of copper or the copper alloy wire (as the surrounding wire), so far as the required tensile strength is achieved, the sectional area of the central wire may be smaller than that of the surrounding wire. For example, the sectional area of the stainless steel may be set in about 70 through 95% of that of copper or the cooper alloy. The first electric wire has slender wire formation and light-weighted formation. Copper or copper alloy is compressed to cover the stainless steel wire without the displace of the stainless steel wire (as central wire), so that the reliability of connection is promoted.

A description will be given here of one example of producing the first electric wire. The compressed conductor of the first electric wire is configured that six surrounding wires made of pure copper is provided to surround the central wire made of the stainless steel. Then, the first electric wire is configured as follows; A diameter of the central wire (SUS304)before being compressed: 0.203 mm A tensile strength at break: 965 Mpa An elongation at break: 46.1%

A diameter of the surrounding wire (the pure copper): 0.203 mm A twisted pitch: 16.3 mm A tensile strength: 76.0 $N/mm^2$ A resistance: 1.6 mΩ/m A material of insulating cover: polyethylene (including foamed species)halogen free material A thickness of the insulating cover: 0.25 mm An elongation at break of the insulating cover: 130% mass of the insulating cover: 0.98 g/m

An outer diameter of the first electric wire: 1.11 mm

Mass of the first electric wire: 3.01 g/m

A breaking load: 87 $N/mm^2$

A description will be given here of another example of producing the first electric wire. The compressed conductor of the first electric wire is configured that six surrounding wires made of pure copper is provided to surround the central wire made of the stainless steel. Further, the twelve surrounding wires made of pure copper is provided to surround the six surrounding wires. Then, the first electric wire is configured as follows;

A diameter of the central wire (SUS304) before being compressed: 0.127 mm

A tensile strength at break: 965 MPa

An elongation at break: 46.1%

A diameter of the surrounding wire (the pure copper) before being compressed: 0.127 mm A twisted pitch: 15.0 mm An outer diameter of compressed conductor: 0.635 mm A conductor size: 0.22 $mm^2$ Mass of the surrounding wire: 2.17 g/m A tensile strength 63.0 $N/mm^2$ A resistance: 81.8 mΩ/m A material of insulating cover: polyethylene (including foamed species) a halogen free material A thickness of the insulating cover: 0.25 mm An elongation at break of the insulating cover: 130%

Mass of the insulating cover: 0.98 g/m

An outer diameter of the first electric wire: 1.14 mm

Mass of the first electric wire: 3.01 g/m

A breaking load of the first electric wire: 74 $N/mm^2$

Figure 4:
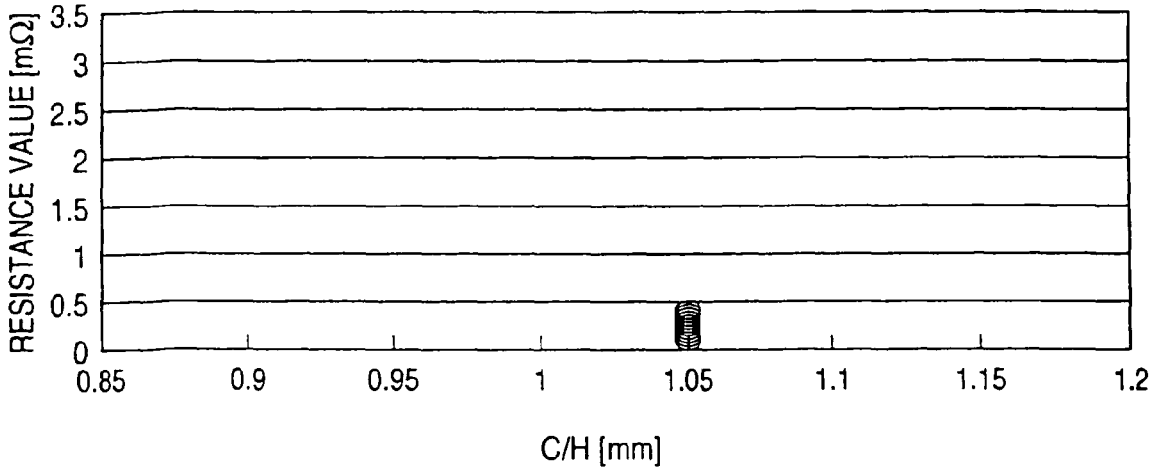
FIG. 4 is a diagram showing data of a relationship between a climp height and resistance at a portion of a distal end of the first electric wire for an automobile to a terminal.

According to the first electric wire, it has been confirmed that slender wire formation and light-weighted formation are achieved and a high tensile strength is achieved. A sectional photograph of the electric wire is taken after pressing a distal end of the electric wire into contact with a connecting terminal made of brass. A connecting state is investigated together with a climp height. FIG. 4 shows a relationship between the climp height and the resistance(Ten examples). It has been confirmed from a result of observation and measurement of these, excellent connection and stable resistance are achieved.

Next, a description will be given of a second electric wire according to the invention. The second electric wire has a compressed conductor configured by compressing an conductor, which includes a central wire made of the stainless steel, a surrounding wire made of copper or the copper alloy which covers to surround the central wire, and a surrounding wire of the stainless steel. The conductor of the second electric wire is configured that a plurality of both the surrounding wires is alternately arranged to surround the central wire.

Figure 5:
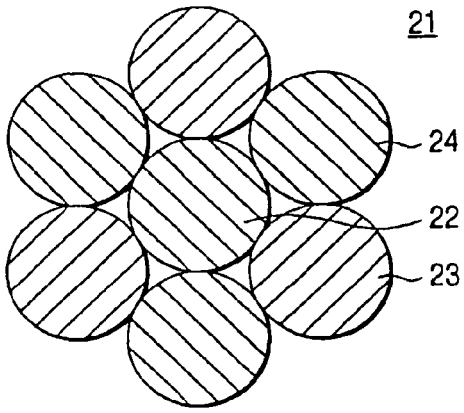
FIG. 5 is a sectional view (before being compressed) of a conductor according to a constitution example of a second electric wire for an automobile.

FIG. 5 shows a sectional view of a state before being compressed of a conductor according to the second electric wire. In FIG. 5, numeral 21 designates an aggregate before being compressed in which pluralities of surrounding wires 23 having copper or a copper alloy and surrounding wires 24 having stainless steel are alternately arranged at a surrounding of a central wire 22 and twisted together to constitute a twisted wire structure. A sectional area of the central wire 22 and sectional areas of the surrounding wires 23, 24 are made to be equal to each other. A compressed conductor is constituted by compressing such an aggregate to constitute a sectional area of 80 through 95% of a sectional area before being compressed by using a compression die or the like. An insulating cover is provided at a surrounding of the compressed conductor directly or via a shield layer to constitute the second electric wire.

As stainless steel used for the central wire 22 and the surrounding wires 24, similar to the case of the first electric wire for an automobile, various kinds thereof can be used, SUS304, SUS316 and the like having a large tensile strength is particularly preferable. Although sectional areas of the central wire 22 and the surrounding wire 24 are pertinently set in accordance with use, normally, the sectional area is about $2.0\times10^{-3}$ through 0.1 $mm^2$ before being compressed.

For copper or a copper alloy used in the surrounding wire 23, similar to the case of the first electric wire for an automobile, various kinds of types normally used in an electric wire can be used, in view of conductivity, tensile strength, elongation and the like, pure copper, Cu—Ag alloy, Cu—Ni—Si alloy and the like are preferably used. The sectional area of the surrounding wire 23 is pertinently set in accordance with use, normally, the sectional area is about $2.0\times10^{-3}$ through 0.1 $mm^2$ before being compressed.

As for the insulating cover, similar to the case of the first electric wire for an automobile, various resin materials of polyvinyl chloride (PVC), polyethylene (including foamed species), a halogen free material, tetrafluoroethylene and the like which has been used in the related arts can be used. A thickness of the insulating cover is pertinently set in accordance with an outer diameter of the compressed conductor.

When a shield layer is used, various kinds of materials having a shield effect which are publicly known in the related can be used.

In the second electric wire, the central wire 22 made of stainless steel is fixed to the center of the compressed conductor. Further, the surrounding wires 24 comprising stainless steel and the surrounding wires 23 having copper or a copper alloy are alternately arranged. Therefore, the tensile strength can sufficiently been achieved as a whole so that slender wire formation can be carried out more. Connecting reliability is promoted in the case of pressing to connect the electric wire to a connecting terminal in a connecting portion.

The second electric wire for an automobile is not limited only to the illustrated constitution example but can variously be modified or changed.

For example, although the second electric wire has 6 surrounding wires to surround the central wire (as 7 twisted type), the second electric wire may be 19 twisted type in which the second electric wire of the 7 twisted type has 12 surrounding wires made of the copper to surround the 6 surrounding wires. FIG. 6 illustrates a structure of an electric wire 31 having the 19 twisted type. As shown in FIG. 6, the electric wire 31 includes a central wire 32, a first layer including 6 surrounding wires 33 and a second layer including 12 surrounding wires 34.

The second electric wire may be constituted without the twisted wire structure.

Although the sectional area of the stainless steel wire is equal to that of the copper wire, so far as the required tensile strength is achieved, the sectional area of the stainless steel wire may be smaller than that of the copper wire. For example, the sectional area of the stainless steel may be set in about 70 through 95% of that of the copper. The second electric wire has slender wire formation and light-weighted formation. Copper wires are compressed to cover the stainless steel wire so that connecting reliability can be promoted.

The surrounding wires may be made of copper alloy instead of the copper.

A description will be given here of one example of producing the second electric wire. The compressed conductor of the second electric wire is configured that six surrounding wires including a surrounding wire made of stainless steel and a surrounding wire made of pure copper which are alternately arranged with each other to surround the central wire made of the stainless steel. Then, the second electric wire is configured as follows;

A diameter of the central wire (SUS304)before being compressed: 0.160 mm
A tensile strength at break: 965 MPa
An elongation at break: 46.1%
A diameter of the surrounding wire (the pure copper) before being compressed: 0.160 mm
A twisted pitch: 12.8 mm
An outer diameter of the compressed conductor: 0.480 mm
A conductor size: 0.13 $mm^2$
Mass of the compressed conductor: 1.20 g/m
A tensile strength of the compressed conductor: 84 $N/mm^2$
A resistance: 309.4 mΩ/m
A material of insulating cover: polyethylene (including foamed species) a halogen free material
A thickness of the insulating cover: 0.25 mm
An elongation at break of the insulating cover: 130%
Mass of the insulating cover: 0.82 g/m
An outer diameter of the second electric wire: 0.98 mm
Mass of the second electric wire: 2.02 g/m
A breaking load: 93 $N/mm^2$ A description will be given here of second example of producing the second electric wire. The compressed conductor of the second electric wire is configured that six surrounding wires including a surrounding wire made of stainless steel and a surrounding wire made of pure copper which are alternately arranged with each other to surround the central wire made of the stainless steel. Then, the second electric wire is configured as follows;

A diameter of the central wire (SUS304)before being compressed: 0.203 mm
A tensile strength at break: 965 MPa
An elongation at break: 46.1%
A diameter of the surrounding wire (the pure copper) before being compressed: 0.203 mm
A twisted pitch: 16.3 mm
An outer diameter of the compressed conductor: 0.809 mm
A conductor size: 0.22 $mm^2$
Mass of the compressed conductor: 1.92 g/m
A tensile strength of the compressed conductor: 139 $N/mm^2$
A resistance: 179.0 mΩ/m
A material of insulating cover: polyethylene (including foamed species) a halogen free material
A thickness of the insulating cover: 0.25 mm
An elongation at break of the insulating cover: 130%
Mass of the insulating cover: 0.98 g/m
An outer diameter of the second electric wire: 1.11 mm
Mass of the second electric wire: 2.91 g/m
A breaking load of the second electric wire: 150 $N/mm^2$ A description will be given here of third example of producing the second electric wire. The compressed conductor of the second electric wire is configured that six surrounding wires include surrounding wire made of stainless steel and surrounding wire made of pure copper which are alternately arranged with each other to surround the central wire made of the stainless steel. Then, the second electric wire is configured as follows;

A diameter of the central wire (SUS304)before being compressed: 0.127 mm
A tensile strength at break: 965 MPa,
An elongation at break: 46.1%,
A diameter of the surrounding wire made of the pure copper before being compressed: 0.127 mm,
A twisted pitch: 15.0 mm,
An outer diameter of the compressed conductor: 0.639 mm,
A conductor size: 0.22 $mm^2$
Mass of the compressed conductor: 2.13 g/m
A tensile strength of the compressed conductor: 88 $N/mm^2$,
A resistance: 98.2 mΩ/m,
A material of insulating cover: polyethylene (including foamed species) a halogen free material,
A thickness of the insulating cover: 0.25 mm,
An elongation at break of the insulating cover: 130%,
Mass of the insulating cover: 0.99 g/m,
An outer diameter of the second electric wire: 1.14 mm,
Mass of the second electric wire: 3.13 g/m, and
A breaking load of the second electric wire: 99 $N/mm^2$ The second electric wire can achieve slender formation and lighten-weight formation, and high tensile strength can be obtained. Further good connecting property and stable resistance can be obtained.

A description will be given here of one example of the third electric wire for an automobile according to the invention. The third electric wire is configured by a compressed conductor which compressed a conductor which includes a central wire of the stainless steel and double surrounding wires which is provide to surround the central wire. A first surrounding wire is made of stainless steel. A second surrounding wire is made of copper or the copper alloy.

According to the third electric wire, the third electric wire has a stainless steel wire, aluminum or an aluminum alloy wire, a material of an insulating cover, and required property etc, which are similar to the first and second electric wires. An explanation will be omitted of a common portion.

A description will be given here of one example of producing the third electric wire according to the invention. The example of the third electric wire is configured by a compressed conductor configured by using six surrounding wires made of stainless steel and twelve surrounding wires made of pure copper.

Then, the third electric wire is configured as follows;

A diameter of both the central wire and the first surrounding wire (SUS304)before being compressed: 0.127 mm
A tensile strength at break: 965 MPa
An elongation at break: 46.1%
A diameter of the second surrounding wire (the pure copper) before being compressed: 0.127 mm
A twisted pitch: 15.0 mm
An outer diameter of the compressed conductor: 0.635 mm
A conductor size: 0.22 $mm^2$
Mass of the compressed conductor: 2.09 g/m
A tensile strength of the compressed conductor: 112 $N/mm^2$
A resistance: 122.8 mΩ/m
A material of insulating cover: polyethylene (including foamed species) a halogen free material
A thickness of the insulating cover: 0.25 mm
an elongation at break of the insulating cover: 130%
Mass of the insulating cover: 0.99 g/m an outer diameter of the third electric wire: 1.14 mm
Mass of the second electric wire: 3.09 g/m
A breaking load of the second electric wire: 128 $N/mm^2$ The third electric wire can achieve slender formation and lighten-weight formation, and high tensile strength can be obtained. Further, good connecting property and stable resistance can be obtained.

Next, a description will be given of the fourth electric wire for an automobile according to the invention. The fourth electric wire is configured by compressed conductor which compresses a conductor. The conductor has central wire and a plurality of surrounding wire made of stainless steel and surrounding wire made of copper or the copper alloy which are alternately arranged with each other and provided to surround the central wire.

According to the fourth electric wire, the fourth electric wire has a stainless steel wire, aluminum or an aluminum alloy wire, a material of an insulating cover, and required property etc, which are similar to the first and second electric wires. An explanation will be omitted of a common portion.

Next, a description will be given of one example of producing the fourth electric wire for an automobile according to the invention. The compressed conductor of the example is configured by compressing a conductor which has a central wire made of pure copper, and six surrounding wires including a surrounding wire made of stainless steel and a surrounding wire made of copper or the copper alloy which are alternately arranged with each other to surround the central wire.

The fourth electric wire is configured as follows;

A diameter of the pure copper wire before being compressed: 0.203 mm
A breaking load: 114 N
A diameter of the stainless steel wire before being compressed: 0.203 mm
A twisted pitch: 16.3 mm
An outer diameter of the compressed conductor; 0.609 mm
A conductor size: 0.22 $mm^2$
Mass of the conductor: 1.96 g
A tensile strength: 114 $N/mm^2$
A resistance: 144.2 mΩ/m
A material of insulating cover: polyethylene (including foamed species) a halogen free material
A thickness of the insulating cover: 0.25 mm
A elongation at break of the insulating cover: 130%
Mass of the insulating cover: 0.98 g/m
An outer diameter of the fourth electric wire: 1.11 mm
Mass of the fourth electric wire: 2.94 g/m
A breaking load of the second electric wire: 125 $N/mm^2$ The fourth electric wire can achieve slender formation and lighten-weight formation, and high tensile strength can be obtained as well as the first to third electric wire. Further, good connecting property and stable resistance can be obtained.

A fifth electric wire for an automobile has a compressed conductor configured by compressing a conductor which is configured by arranging a plurality of surrounding wires comprising aluminum or an aluminum alloy at a surrounding of a central wire made of stainless steel to surround the central wire.

According to the fifth electric wire, a material of the surrounding wire is constituted by aluminum or an aluminum alloy in place of copper or the copper alloy in the first electric wire for an automobile. The other constitution or the like is similar and therefore, an explanation will be omitted of a common portion thereof.

Although for aluminum or an aluminum alloy used in the fifth electric wire, various kinds of types used normally for an electric wire can be used, in view of conductivity, tensile strength, elongation or the like, JIS 1000 series alloy, pure aluminum or the like is preferably used.

Next, a description will be given of a sixth electric wire for an automobile. The sixth electric wire has a compressed conductor configured by compressing an conductor which includes a central wire made of the stainless steel, a surrounding wire made of aluminum or the aluminum alloy which covers to surround the central wire, and a surrounding wire of the stainless steel which covers to surround the central wire. The conductor of the sixth electric wire is configured that a plurality of both the surrounding wires is alternately arranged to surround the central wire.

According to the sixth electric wire for an automobile, a material of the surrounding wire is constituted by aluminum or an aluminum alloy in place of copper or the copper alloy in the second electric wire for an automobile. The other constitution or the like is similar and therefore, an explanation will be omitted of a common portion.

For aluminum or an aluminum alloy used in the sixth electric wire, aluminum or an aluminum alloy used in the fifth electric wire can similarly be used.

Next, a description will be given of seventh electric wire for an automobile according to the invention. The seventh electric wire is configured by compressed conductor configured by compressing a conductor which has two surrounding wires to surround a central wire made of stainless steel. First surrounding wire is a wire made of stainless wire. Second surrounding wire is a wire made of aluminum or the aluminum alloy.

According to the seventh electric wire, the seventh electric wire has a stainless steel wire, aluminum or an aluminum alloy wire, a material of an insulating cover, and required property etc, which are similar to the fifth and sixth electric wires. An explanation will be omitted of a common portion.

Next, a description will be given of the eighth electric wire for an automobile according to the invention. The eighth electric wire is configured by a compressed conductor configured by compressing a conductor which has a plurality of surrounding wires to surround a central wire made of aluminum or the aluminum alloy. The plurality of surrounding wires include a surrounding wire made of a stainless steel and a surrounding wire made of aluminum or the aluminum alloy.

According to the eighth electric wire, the eighth electric wire has a stainless steel wire, aluminum or the aluminum alloy wire, a material of an insulating cover, and required property etc, which are similar to the fifth and sixth electric wires. An explanation will be omitted of a common portion.

According to the fifth to eighth electric wires, slender formation, lighting formation, and high extension strength can be obtained as well as the first to fourth electric wires. Connecting property of the eighth electric wire is good, and the resistance is stable.

What is claimed is:

1. An electric wire for an automobile having a compressed wire configured by compressing a conductor having a plurality of surrounding wires to surround a central wire, wherein the surrounding wires and the central wire are made of aluminum or an aluminum alloy and a stainless steel.

2. The electric wire according to claim 1, wherein the central wire is made of the stainless steel, and wherein the surrounding wires are made of aluminum or the aluminum alloy.

3. The electric wire according to claim 2, wherein the surrounding wires consist of six wires, and the surrounding wires form a single layer.

4. The electric wire according to claim 2, wherein the surrounding wires form two layers, the surrounding wires have six wires in a first layer of the two layers to surround the central wire, and the surrounding wires have twelve wires in a second layer of the two layers to surround the first layer.

5. The electric wire according to claim 1, wherein the central wire is made of the stainless steel, the surrounding wires have first surrounding wires made of aluminum or the aluminum alloy and second surrounding wires made of the stainless steel, and the first surrounding wires and the second surrounding wires are alternately arranged with respect to one another.

6. The electric wire according to claim 5, wherein the surrounding wires form a first layer, the first layer being a single layer, and the surrounding wires include six wires.

7. The electric wire according to claim 6, wherein twelve surrounding wires made of aluminum or the aluminum alloy form a second layer and are disposed to surround the first layer.

8. The electric wire according to claim 1, wherein the central wire is made of the stainless steel, the surrounding wires form two layers, the surrounding wires are made of the stainless steel in a first layer of the two layers to surround the central wire, and the surrounding wires are made of aluminum or the aluminum alloy in a second layer of the two layers to surround the first layer.

9. The electric wire according to claim 1, wherein the central wire is made of aluminum or the aluminum alloy, the surrounding wires have first surrounding wires made of the stainless steel and second surrounding wires made of aluminum or the aluminum alloy, and the first surrounding wires and the second surrounding wires are alternately arranged with respect to one another.

10. The electric wire according to claim 9, wherein the surrounding wires form a first layer, the first layer being a single layer, and the surrounding wires consist of six wires.

11. The electric wire according to claim 10, wherein twelve surrounding wires made of aluminum or the aluminum alloy form a second layer and are disposed to surround the first layer.

12. The electric wire according to claim 1, wherein a sectional area of the wire made of the stainless steel is equal to a sectional area of the wire made of aluminum or the aluminum alloy.

13. The electric wire according to claim 1, wherein a sectional area of the wire made of the stainless steel is smaller than a sectional area of the wire made of aluminum or the aluminum alloy.

14. The electric wire according to claim 13, wherein the sectional area of the wire made of the stainless steel is set in 70% through 95% of the sectional area of the wire made of aluminum or the aluminum alloy.

* * * * *